US006637246B1

(12) United States Patent
Shimanovski et al.

(10) Patent No.: US 6,637,246 B1
(45) Date of Patent: Oct. 28, 2003

(54) TUBULAR PART LOCATOR FOR HYDROFORMING APPARATUS

(75) Inventors: Bruce Steven Shimanovski, Southfield, MI (US); Mircea M. Ghiran, Lake Orion, MI (US); George Thomas Winterhalter, Berkley, MI (US); Romuald Gmurowski, Rochester Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/278,428

(22) Filed: Oct. 23, 2002

(51) Int. Cl.[7] ..... B21D 26/02; B21D 9/15; B23P 17/02

(52) U.S. Cl. ..... 72/62; 72/61; 29/421.1

(58) Field of Search ..... 72/59, 60, 61, 72/62, 316, 318; 29/421.1

(56) References Cited

U.S. PATENT DOCUMENTS 3,501,934 A * 3/1970 Engel et al. ..... 72/62
4,641,407 A * 2/1987 Blevins et al. ..... 29/237
5,233,856 A * 8/1993 Shimanovski et al. ..... 72/62
5,321,964 A 6/1994 Shimanovski et al. ..... 72/62
5,481,892 A * 1/1996 Roper et al. ..... 72/61
5,553,474 A * 9/1996 Nokajima et al. ..... 72/60
5,775,153 A * 7/1998 Rigsby et al. ..... 72/58
6,006,567 A * 12/1999 Brown et al. ..... 72/58
6,154,944 A * 12/2000 Mason et al. ..... 29/421.1
6,510,720 B1 * 1/2003 Newman et al. ..... 72/61

* cited by examiner

*Primary Examiner*—David Jones
(74) *Attorney, Agent, or Firm*—Charles E. Leahy

(57) ABSTRACT

The seal units that form part of a hydroforming apparatus that further includes dies for hydroforming parts are each provided with a tubular part locator for locating and clamping a tubular part in alignment with the seal unit. The part locator basically comprises a locator member, a pair of pivot arms and a backup member wherein the locator member and the pivot arms together with the seal unit are supported by an elevator that aligns the seal unit and the locator member with the hydroforming dies when the latter close on the tubular part. The locator member has a concave surface and guide surfaces wherein the concave surface has a shape conforming to the outer surface of the part and the guide surfaces are adapted to guide an end portion of the tubular part onto the concave surface of the locator member and thereby into alignment with the seal unit. The pivot arms each have a concave surface also conforming to the outer surface of the part and are adapted on pivoting to clamping positions to clamp the end portion of the part on the concave surface of the locator member. The backup member is adapted to hold the pivot arms in their clamping position during hydroforming of the part and may also include a concave surface that is adapted to clamp the end portion of the tubular part on the concave surface of the locator member in cooperation with the concave surface of the pivot arms.

15 Claims, 11 Drawing Sheets

TUBULAR PART LOCATOR FOR HYDROFORMING APPARATUS

TECHNICAL FIELD

This invention relates to hydroforming apparatus and more particularly to devices for locating a tubular part in the apparatus in alignment with the seal units and with respect to the dies in the apparatus.

BACKGROUND OF THE INVENTION

In the apparatus for hydroforming a tubular part, there is typically a lower die and an upper die that are pressed together to form a die cavity that extends about the part wherein the cavity has the shape to which the part is required to formed. In the hydroforming process, hydraulic fluid under pressure is delivered to the interior of the part through seal units that are associated with the lower die and are caused to engage opposite end portions of the part that project outward of the dies when the dies are closed about the part. To reduce cycle time, the seal units may be brought into sealing engagement with the ends of the part prior to the dies closing and it is important in that event that the ends of the part be accurately aligned with the seal units to effect their sealed engagement. As otherwise, proper sealing may not be obtained and the part and/or the seal units may be damaged.

In addition, the seal units may also be used to center the part lengthwise with respect to the dies prior to die closure through their engagement with the ends of the part. In that case, it is important that when the seal units are caused to engage with the ends of the part for such centering operation they do so in an efficient and reliable manner. Moreover, in the case where end portions of the part do project from the dies for engagement with the seal units, there is the possibility that the projecting end portions in an area where they are not captured by the seal units may burst during the hydroforming of the part and result in having to scrap the part.

An example of hydroforming apparatus that does provide for accurate alignment of projecting end portions of a round tubular part with the seal units is disclosed in U.S. Pat. No. 5,321,964 assigned to the assignee of this invention. As disclosed therein, each of the seal units is provided with a locator member and a backup member. The backup members are fixed with respect to the upper die and the locator members and their associated seal unit are mounted on separate elevators that are supported by springs with respect to the lower die. With the seal units retracted, the tubular part is loaded such as by a robot and at what will be its projecting end portions onto the locator members which locate the end portions in alignment with the respective seal units while the seal units and locator members are located and held by their respective elevator at an elevated position with respect to the lower die. The seal units are then extended to sealingly engage the respective end portions of the part while centering the part lengthwise with respect to the dies. The upper die is then lowered onto and pressed against the lower die to form the die cavity about the part. As the upper die is lowered to form the die cavity, this upper die movement also causes capture of the projecting end portions of the part between the respective locator and backup members as the dies are pressed together. This upper die movement also causes lowering of the elevators and thereby the part and the engaged seal units whereby an inward section of the end portions of the part ultimately seating on a terminal cavity bore portion in the lower die and in a corresponding terminal cavity bore portion in the upper die as the dies are pressed together.

While such apparatus has proven to provide satisfactory alignment of the part with the seal units, it has been found that because the end portions of the part are not fully radially restrained by the locator members of the respective seal units during the engagement of the seal units with the part prior to die closure, the part may bounce or be jostled and as a result interfere with the centering of the part with respect to the dies by the seal units and possibly result in damage to the part and/or the seal units.

In addition, the part as received from the tube manufacturer may have an outer diameter that is either undersize or oversize to a significant degree relative to the specified nominal dimension of the tube stock. As a result, these variations in dimensions can worsen the degree of bouncing and/or jostling that can occur when the seal units are advanced to engage the ends of the part to effect centering of the part between the dies and their sealing engagement therewith.

SUMMARY OF THE INVENTION

The present invention solves such problems by providing each seal unit with a tubular part locator comprising a locator member directly associated with the seal unit in a fixed relationship, a backup member rigidly fastened to the upper die and a pair of pivot arms which are mounted on the locator member and are operated by separate pneumatic cylinders. And wherein each seal unit and the associated locator member and pivot arms are mounted on an elevator.

The locator member has a concave surface and adjoining guide surfaces wherein the concave surface is of limited extent and conforms to the outer surface of the part and has a centerline coincident with that of the seal unit. And wherein the guide surfaces are adapted to guide an end portion of the part onto the concave surface of the locator member and thereby into alignment with the seal unit.

The pivot arms also have a concave surface conforming to the outer surface of the part but of substantially less extent than the concave surface of the locator member and are adapted on pivotal movement by their pneumatic cylinder to clamping positions to clamp the end portion of the part on the concave surface of the locator member to thereby prevent bouncing or jostling of the part while the seal unit is then brought into sealing engagement with the end portion of the part. The backup member also has a concave surface of limited extent conforming to the outer surface of the part and is adapted to move with the upper die to a backup position as the upper dies closes on the part where its concave surface then helps clamp the end portion of the part on the concave surface of the locator member.

The backup member when in its backup-clamping position is also adapted to hold the pivot arms in their clamping position during hydroforming of the part to thereby relieve the pneumatic cylinders of having to resist the hydroforming force acting in the end portion of the part outward on the pivot arms. Wherein there is provided a small predetermined clearance between the backup member and pivot arms that allows the end portion of the part to bulge slightly outward into hydraulically forced contact with the concave surfaces of the pivot arms and the backup member to assist in firmly holding the part in place. With there being a greater, but still a relatively small, amount of bulging allowed in the case of a nominal sized part and the smallest anticipated undersize part.

Moreover, the combined concave surfaces of the locator member, pivot arms and backup member completely encircle the end portion of the part between the dies and the respective seal unit and thereby act to prevent bursting of the end portion of the part during the hydroforming operation. In addition, the concave surfaces of the pivot arms and that of the backup member and the locator member are made slightly oversize by a predetermined amount with respect to the maximum anticipated outer diameter of the part as received from the tube manufacturer. Such that during the hydroforming of the part, the end portion regardless of its diameter bulges or expands slightly outward and tightly engages all these surfaces to help hold the part firmly in place.

Moreover, the components of the tubular part locator may be structured and arranged so as to allow the overall length and width of the seal unit including the part locator to be kept to a minimum. In addition, the tubular part locator lends its self to enhancing variations in certain of its components. For example, an optional pivot arm construction of short length that reduces the loading path of the part and thereby the cycle time for this operation. Another example is an optional convex funnel-shaped entryway in the locator member that also contributes to reducing loading time.

These and other aspects of the present invention will become more apparent from the accompanying drawings and following detailed description of exemplary embodiments of the invention.

DESCRIPTION OF EXEMPLARY EMBODIMENTS

Figure 1:
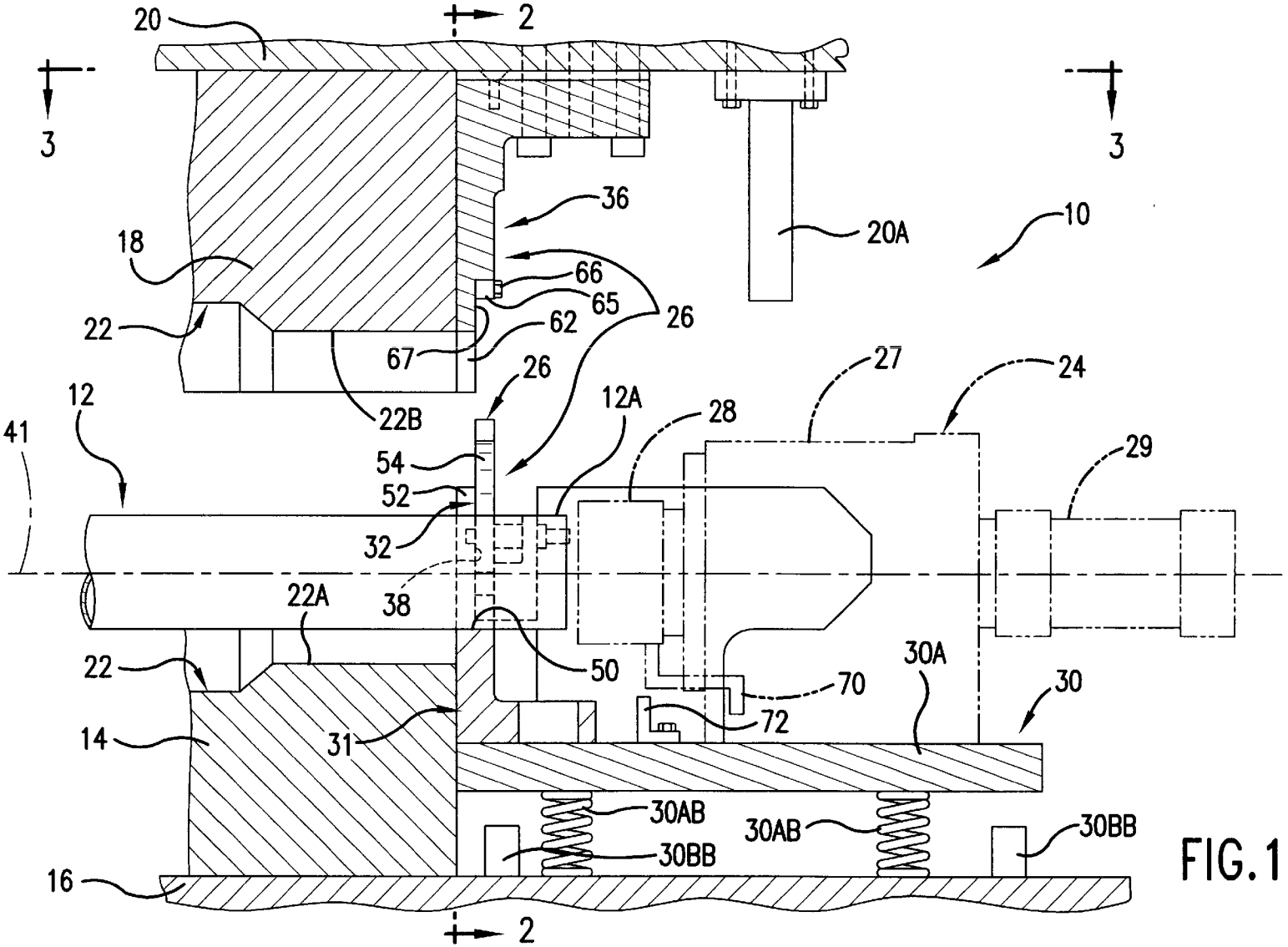
FIG. 1 is a partial side view in section of hydroforming apparatus that includes an exemplary embodiment of the tubular part locator according to the present invention.

Referring to FIGS. 1–8, there is shown hydroforming apparatus 10 for hydroforming a round tubular part 12 to a required shape. Wherein only one end portion of the apparatus and the part is shown and it will be understood that the other end portion of the apparatus and the part is like that shown and described herein and operates in like manner.

The apparatus comprises a lower die 14 that is rigidly fastened to the bedplate 16 of a hydroforming press of a conventional type and an upper die 18 that is rigidly fastened to the press plate 20 of the press. In a conventional manner, the upper die 18 when pressed against the lower die 14 cooperates with the lower die to form a die cavity 22 about the part of the required shape to which the part is to be formed. Wherein an end portion 12A of the part is left projecting from the dies where the die cavity terminates in a cylindrical bore that is formed by oppositely facing concave semi-cylindrical die cavity surfaces 22A and 22B in the respective dies 14 and 18.

A seal unit 24 of a conventional type and a tubular part locator 26 according to the present invention are located at one end of the dies 14 and 18 (see FIGS. 1 and 3) and it will be understood as mentioned earlier that a like seal unit and tubular part locator are located at the opposite end of the dies and operate in like manner. One purpose of the tubular part locators being to initially accurately locate the respective end portions of the part being processed in alignment with the respective seal units prior to engagement of the latter with the end portions of the part.

The seal unit 24 includes a housing 27 supporting a seal carrier 28 and an actuator 29 wherein the latter is operable to engage the seal carrier with the end portion 12A of the part. The seal unit 24 is mounted on an elevator 30 that is supported by springs 30AB on the bedplate 16 and is limited to vertical movement only. Wherein the seal unit housing 27 is rigidly fastened to a floor 30A of the elevator and the elevator is normally held by the springs 30AB in an elevated position as shown in FIGS. 1–5 and is moved downward against the springs with lowering of the upper die 18 as shown in FIGS. 6 and 7. Such downward movement being effected by a pusher member 20A that is rigidly fastened to the press plate 20 and pushes down on the seal unit housing 27 as the upper die 18 closes. And wherein the downward movement of the elevator 30 is limited by the elevator floor 30A bottoming or stopping against stop members 30BB that are rigidly fastened to the bedplate 16.

The stop members 30BB act to position the tubular part, when the seal unit is engaged therewith, in alignment with the cylindrical die cavity bore formed by the die cavity surfaces 22A and 22B when the dies are closed. The functions of the elevator supported seal unit 24 and the like elevated supported seal unit at the other end of the part being to sealingly engage the ends of the part, to center the part lengthwise between the dies prior to die closure, to supply hydraulic fluid under pressure to the interior of the part to thereby form the part to the die cavity surface, and to later exhaust this fluid. The seal unit and elevator at each end of the dies are like those disclosed in the aforementioned U.S. Pat. No. 5,321,964 that is hereby incorporated by reference and to which reference is made for a more detailed disclosure thereof apart from what is shown and described herein.

The tubular part locator 26 generally comprises a locator member 31, a pair of pivot arms 32, a pair of pneumatic cylinders 34 and a backup member 36. The locator member 31, like the seal unit housing 27, is rigidly fastened to the elevator floor 30 and the backup member 36 is located directly overhead the locator member 31 and is rigidly fastened to the press plate 20. The pivot arms 32 are operable to capture the end portion of the part and are located opposite each other in side recesses 38 in a rear side of the locator member 31 so as to be flush with this rear side. The pivot arms 32 are pivotally connected each by a pin 40 to the locator member 31 for pivotal movement about the pin at right angles to the centerline 41 of the seal unit 24 and wherein the axes of these pivot pins lie in a horizontal plane passing through the centerline 41. The pivot arms 32 are pivoted by the respective pneumatic cylinders 34 which each have an eye bracket 42 pivotally connected by a pin 44 to the elevator floor 30 and their piston rod 46 pivotally connected by a pin 48 to the respective pivot arm.

The locator member 31 is adapted to receive the end portion 12A of the part in axial alignment with the seal unit 24 by the provision of an upwardly-facing semi-circular concave cylindrical surface 50 and adjoining flat edge surfaces 52 that converge in the direction of the concave surface 50 to form a part receiving pocket. Wherein the concave surface 50 forming the pocket conforms to the outer surface of the part 12 and has a centerline coincident with the centerline 41 of the seal unit 24. And wherein the converging edge surfaces 52 provide guides for receiving and guiding in a funneling manner the end portion 12A of the part downward onto the concave surface 50 of the locator member 31 and thus into alignment with the seal unit 24.

Figure 5:
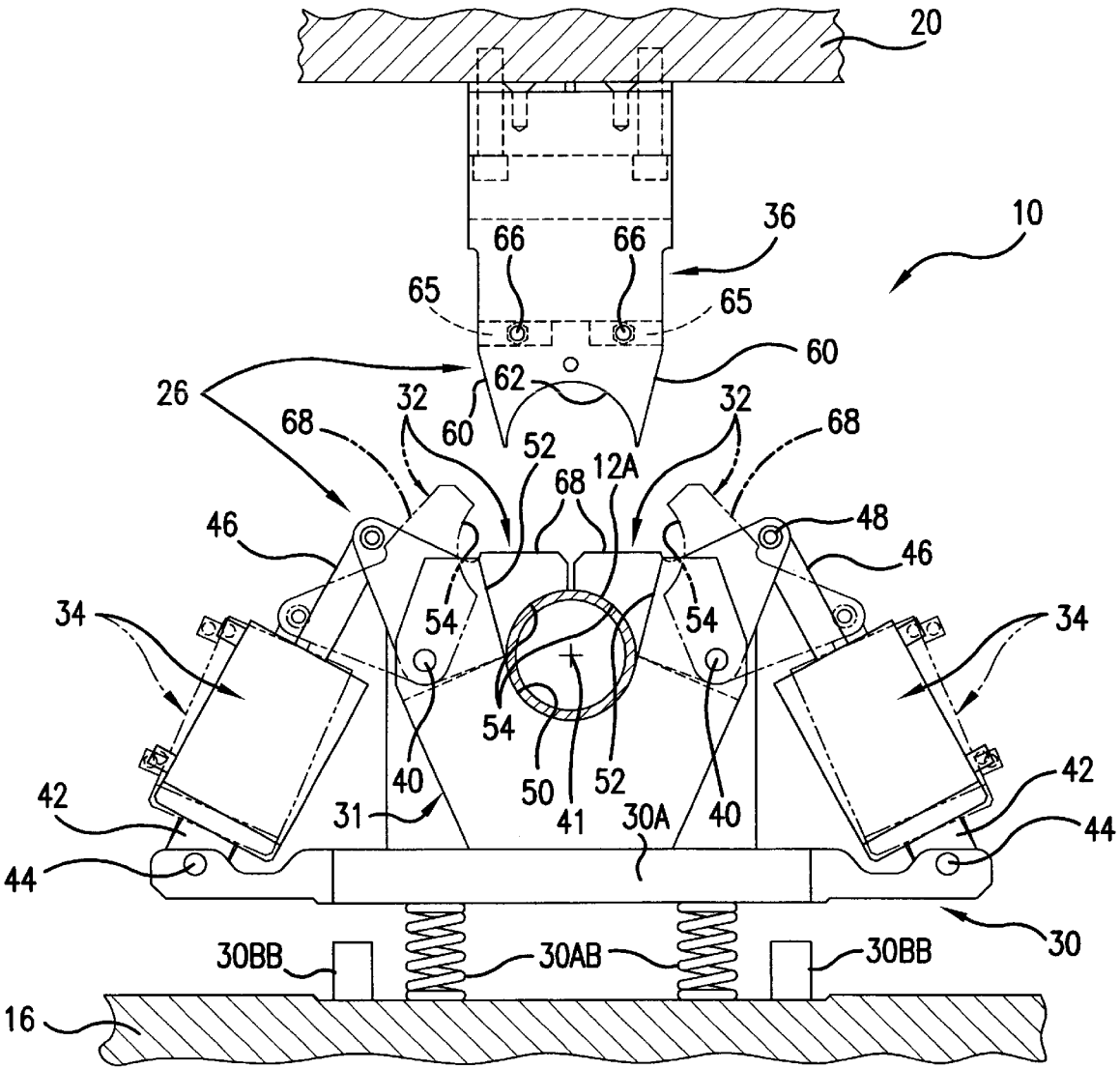
FIG. 5 is a view like FIG. 2 but showing the tubular part clamped by the pivot arms of the part locator.
Figure 6:
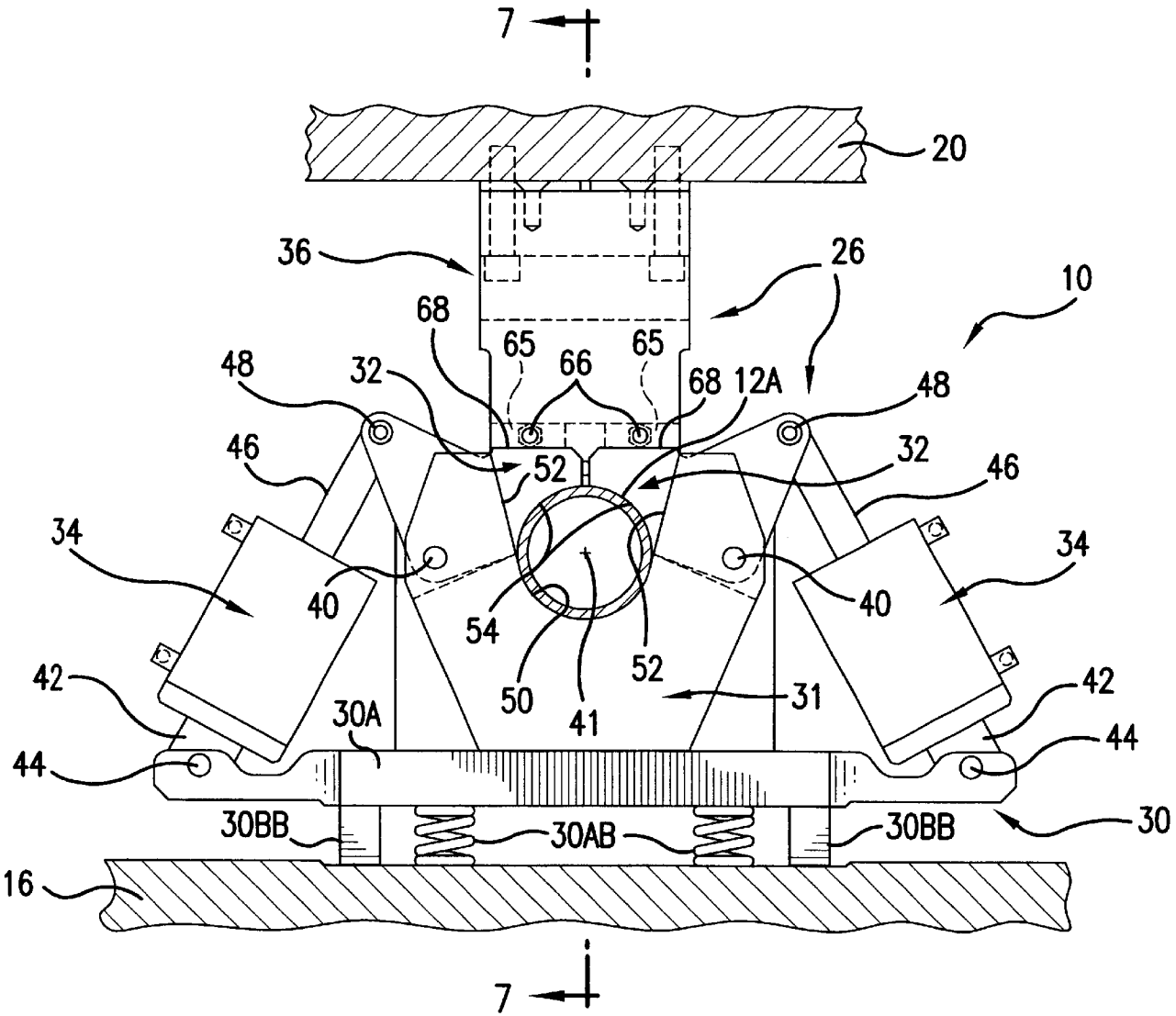
FIG. 6 is a view like FIG. 5 but showing the tubular part additionally clamped by the backup member of the part locator.
Figure 7:
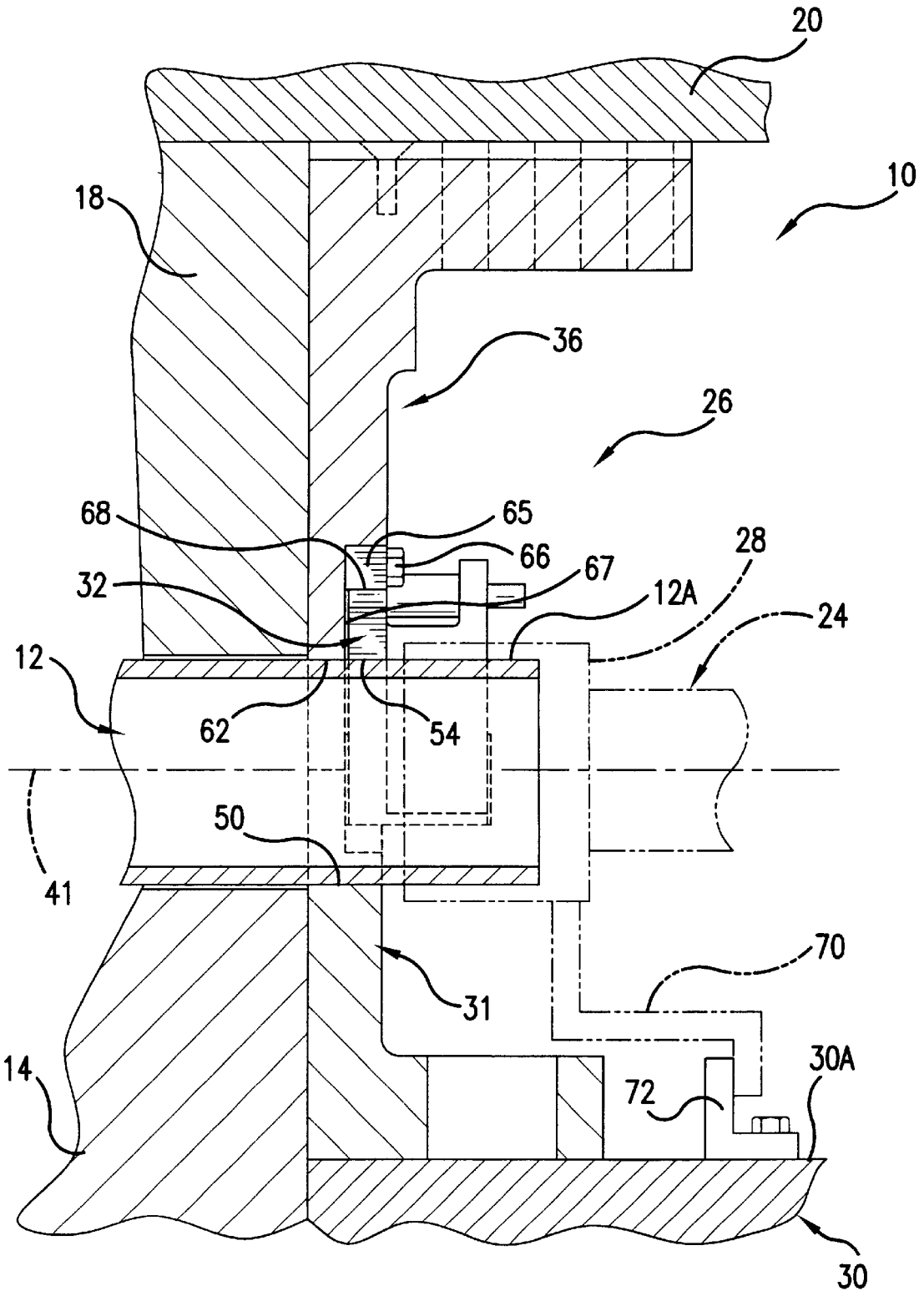
FIG. 7 is an enlarged view taken along the line 7—7 in FIG. 6 when looking in the direction of the arrows.
Figure 8:
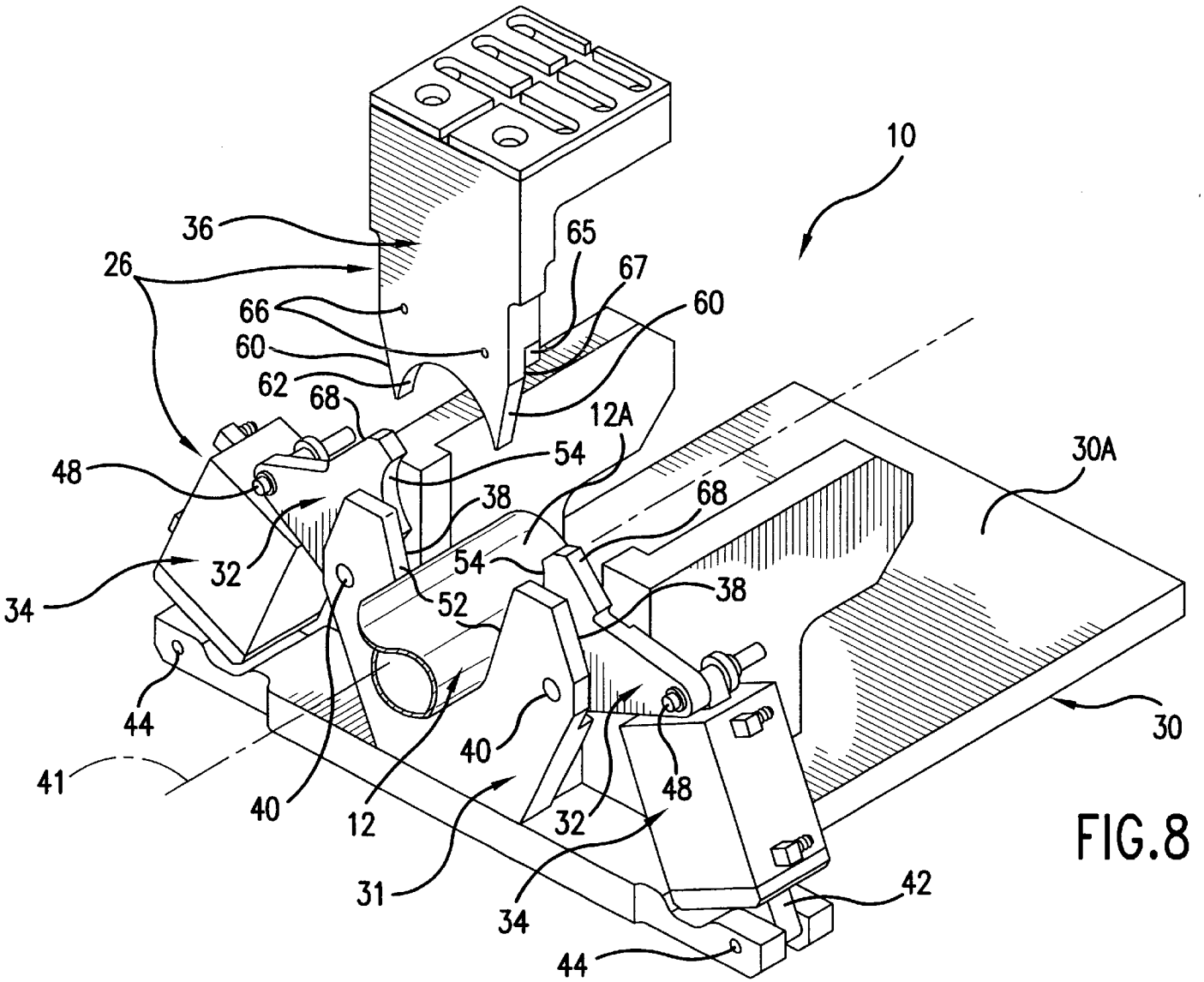
FIG. 8 is a three dimensional view of the part locator in FIG. 1 without the seal unit.

The pivot arms 32 have a quarter-circle concave cylindrical surface 54 conforming to the outer surface of the part 12 and are pivoted in opposite directions by their pneumatic cylinder 34 from a retracted part clearing position (see FIG. 2) to an extended part clamping position (see FIGS. 5–7). The pivot arms 32 are configured so that when in their open position they allow loading of the part onto the locator member 31 and when in their clamping position their concave surface 54 co-operates with the concave surface 50 of the locator member 31 to fully encircle and clamp the end portion 12A of the part 12 on the locator member. Wherein the locator member 31 is provided with a small predetermined diametrical clearance with respect to the maximum anticipated outer diameter of the part 12 supplied by the tube manufacturer so as to assure that the part is fully received on the concave surface 50 of the locator member 31. For example, a diametric clearance in the range of 0.001–0.003 inches has been found to be generally satisfactory in automotive part applications.

The backup member 36 extends downwardly from the press plate 20 and has flat converging edge surfaces 60 and a semi-circular concave cylindrical surface 62 that faces downward and is located between the surfaces 60 and conforms to the outer surface of the part 12. Wherein the concave surface 62 is located opposite the concave surface 50 of the locator member 31 in the area thereof adjoining the front side of the locator member and whereas the remaining area of the concave surface 50 is located opposite the pivot arms 32 and their concave surface 54.

Following the loading of a part and clamping of the part to the locator member 31 with the pivot arms 32, the backup member 36 is lowered with the upper die 18 and as the latter is lowered to press against the lower die 14, the elevator 30 is also lowered by the pusher member 20A pressing against the seal unit housing 27 mounted on the elevator floor 30A and thereby against the springs 30AB. With such downward movement of the elevator 30 continuing until the dies are pressed together whereupon the floor 30A of the elevator bottoms against the elevator stop members 30BB to align the part and the seal unit engaged therewith with the bore portion 22A–22B of the die cavity 22. While the angled edge surfaces 60 of the backup member 36 abut with the edge surfaces 52 of the locator member 31 and the concave surface 62 of the backup member is then located so that it cooperates with the concave surface 50 of the locator member, together with the concave surfaces 54 of the pivot arms 32, to encircle and contain with a clamping action the end portion 12A of the part in position on the part locator 26 and in accurate alignment with the bore portion of the die cavity.

The backup member 36 is also adapted to rigidly hold the pivot arms 32 in their capturing position when the backup member is moved to its capturing position so as to not require the pneumatic cylinders 34 to hold the pivot arms in their capturing position during the hydroforming of the part when a resulting hydraulic force is developed in the clamped end portions of the part. Such holding of the pivot arms 32 being provided by stop members 65 that are each rigidly fastened by a fastener 66 in a vertically adjustable manner to the backup member 36 in a recess 67 in the rear side of the backup member that also serves to receive the pivot arms 54 when the backup member is lowered with the upper die. See FIG. 7.

The stop members 65 have an abuttable relationship with a flat edge surface 68 of the pivot arms and are adjusted so as to be located with a small clearance (for example, 0.001–0.003 inches) with respect to the pivot arm edge surfaces 68 when the latter are in their clamping position. The purpose of this clearance being to allow for variations in the diameter of the part as received from the tube manufacturer so the concave surface 54 of the pivot arms 32 and the concave surface of the 62 of the backup member 36 constrain the end portion 12A of the part but are prevented from mechanically altering the form of the part when the diameter of the latter is oversize and the lower die is pressed against the lower die. But then when the part is hydroformed in the die cavity 22, the concave surface 54 of the pivot arms as well as the concave surface 62 of the backup member is rigidly held in position to backup the part and along with the concave surface 50 of the locator member 31 limit the bulging of the end portion 12A of the part extending between the end of the dies and the seal carrier 28. Moreover, the elevator stop members 30BB also take some of the separating force under the locator member 31 during hydroforming since the springs 30AB are not strong enough to resist this separating force.

In further regard to the seal unit 24, the seal carrier 28 is initially positioned in a retracted position by the actuator 29 as shown in phantom lines in FIG. 1 to permit loading of the part and is eventually returned to this position to permit removal of the part following the hydroforming of the part. Following the loading of a part onto the locator member 31 and prior die closure, the seal carrier 28 is extended by the actuator 29 from its retracted position to a seal effecting and part centering position as shown in phantom lines in FIG. 7 wherein during such extension, the seal carrier 28 is received on the end portion 12A of the part. The seal carrier 28 has a stop engaging member 70 that then eventually engages a stop member 72 rigidly fastened to the elevator floor and causes a seal in the carrier member to seal against the outer surface of the end portion 12A of the part. Whereby when the seal carrier reaches its fully extended position, it together with its counter part on the seal unit at the other end of the part, centers the part lengthwise on the lower die 14 while effecting sealing between the seal units and the part.

Figure 2:
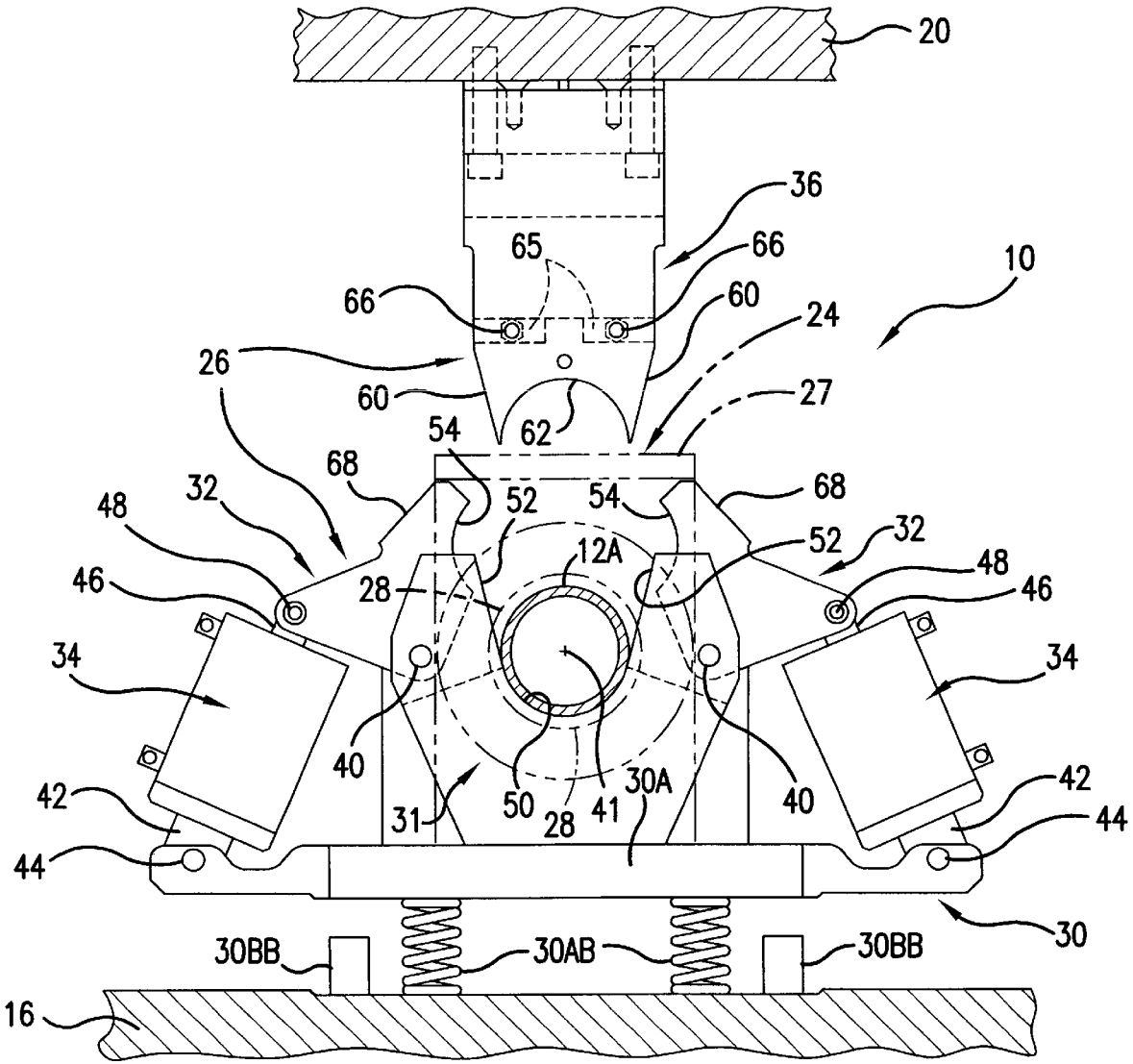
FIG. 2 is a view taken along the line 2—2 in FIG. 1 when looking in the direction of the arrows.
Figure 3:
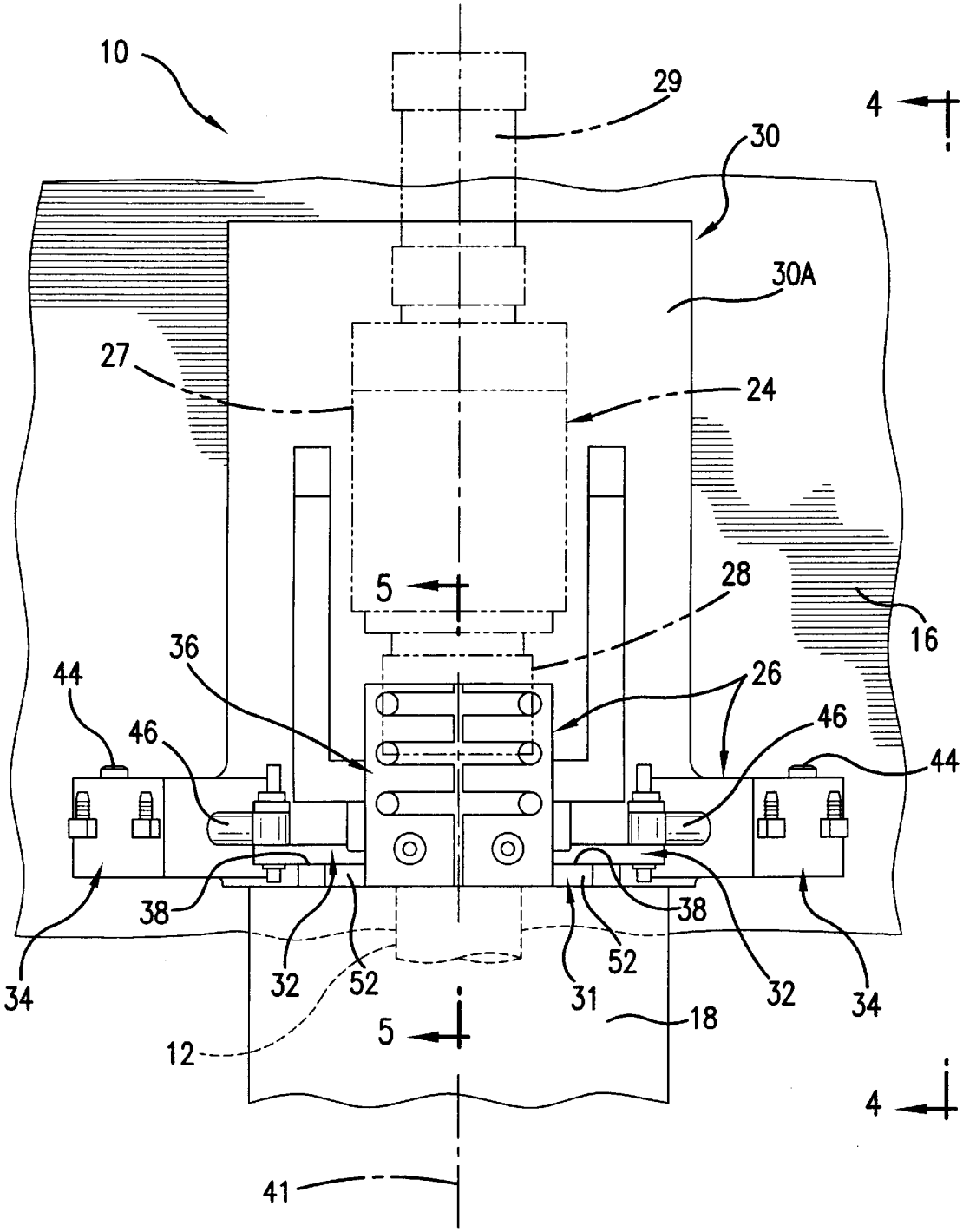
FIG. 3 is a view taken along the line 3—3 in FIG. 1 when looking in the direction of the arrows.
Figure 4:
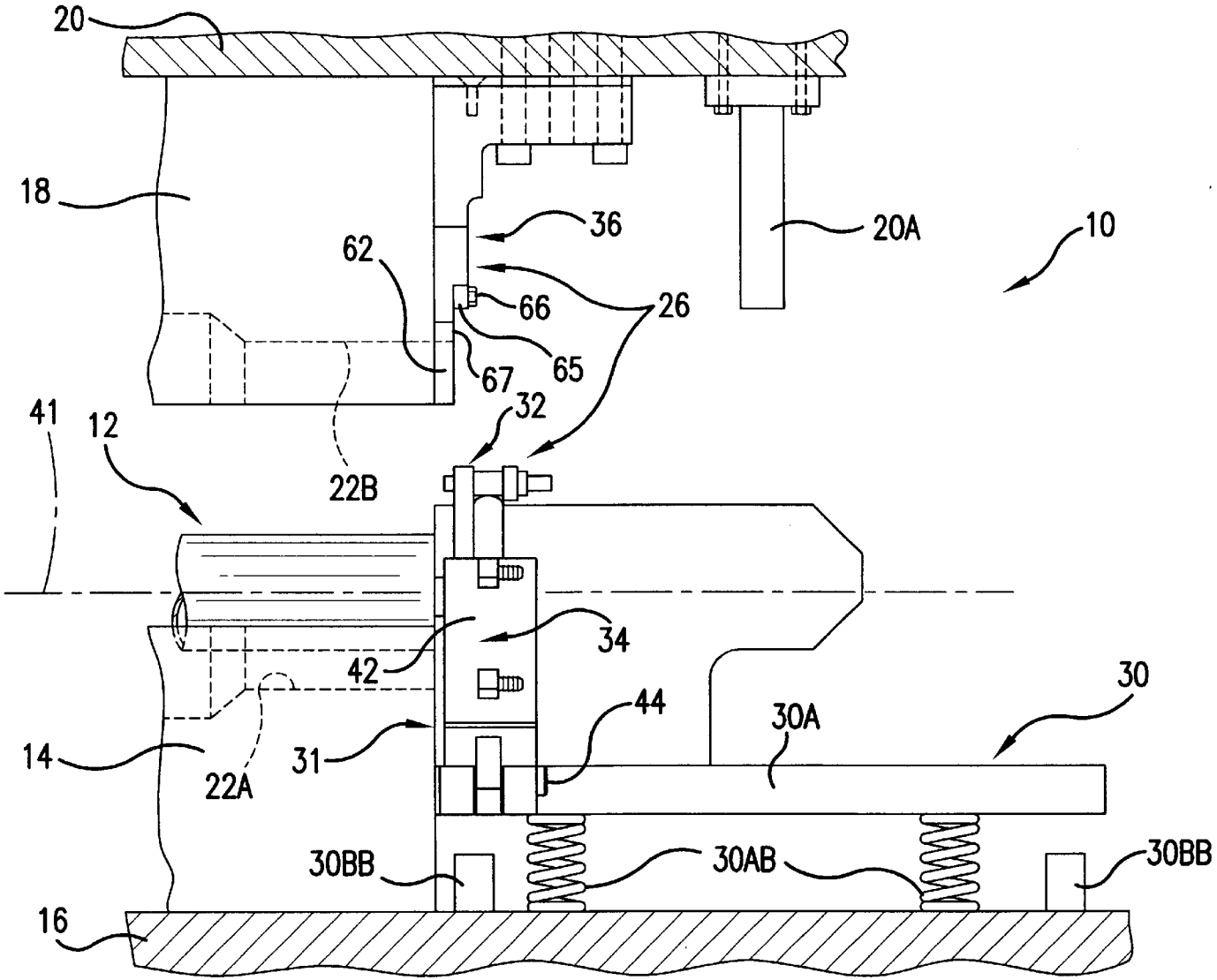
FIG. 4 is a view similar taken along the line 4—4 in FIG. 3 when looking in the direction of the arrows.

Describing now the complete sequence of operations of the tubular part locator 26 as it functions in the hydroforming process and with the understanding that a like tubular part locator and seal unit are provided at a like location at the opposite end of the dies and operates simultaneously in like manner, the upper die 18 and backup member 36 and the elevator 30A are initially held in a raised position and the seal unit 24 is retracted as shown in FIG. 1 and as described earlier. The pivot arms 32 of the tubular part locator 26 are at that time positioned in their retracted open position by their pneumatic cylinder 34 and the part to be hydroformed is then positioned between the dies by suitable means such as a robot of a conventional type (not shown) that drops the part from above the top of the locator member 31 in order to minimize the cycle time and so that the respective end portion 12A of the part enters between the converging guide surfaces 52 of the locator member 31. The guide surface 52 then guide or funnel the end portion 12A of the part as need be onto the concave surface 50 of the locator member 31 and thus into alignment with the seal carrier 28 of the seal unit 24 as shown in FIGS. 1 and 2. Thus allowing the robot to leave immediately to thereby further minimize the cycle time.

The pneumatic cylinders 34 are then immediately operated to swing the pivot arms 32 to their closed clamping position as shown in FIG. 5 where their concave surface 54 captures the end portion of the part against the concave surface 50 of the locator member 31 to mechanically hold the end portion of the part in alignment with the seal carrier 28. The seal carrier 28 in the seal unit 24 is then immediately advanced to sealingly engage with the end portion 12A of the part while the tubular part locator and the seal carrier of the seal unit at the other end of the part are likewise operated and wherein the seal units acting together also center the part lengthwise between the dies 14 and 18 while they remain open and the part remains elevated above the lower die 14.

The hydroforming fluid is then supplied through the engaged seal units to prefill the part prior to die closure to prevent the part from crushing or buckling if it is prone to do so during die closure. On lowering of the upper die 18, the backup member 36 then clamps the end portion 12A of the part to the concave surface 50 of the locator member 31 as the dies close. Lowering of the upper die also lowers the pusher member 20A which effects lowering of the elevator 30A and thereby the locator member 31, the pivot arms 32, pneumatic cylinders 42 and the then engaged seal unit 24. With the elevator eventually stopping against the stop members 30BB to align the part and the engaged seal unit with the dies as they close and with the backup member 36 in addition providing backup for the pneumatic cylinders 42 in holding the clamping positions of the pivot arms 32.

Hydroforming of the part is performed immediately following die closure by supplying the hydroforming fluid through the seal units to the interior of the part at a pressure sufficient to form the wall of the part outward against the die cavity surface. This pressure also acts in the region of the end portion of the part extending between the die cavity 22 and the seal carrier 28 and can have the potential to burst the part in this region. And such adverse action is prevented by the physical containment of this region of the end portion of the part by the tubular part locator 26. Wherein the combined concave surfaces 50, 54 and 62 of the locator member 31, pivot arms 32 and backup member 36 provide complete containment of the end portion of the part between the dies and the seal units and wherein the backup member 36 with its stop members 65 provides a rigid stop for the pivot arms 32 so that the pneumatic cylinders 34 are not required to provide the necessary resisting force to any bulging that does occur in this contained region of the part outside the die cavity.

Following the hydroforming operation, the fluid is exhausted from the part through the seal unit 24, the upper die is raised to its open position returning the backup member 36 of the tubular part locator to its retracted position while allowing the elevator 30 with the seal unit 24 and the part locator member 31 and its associated pivot arms and pneumatic cylinders 34 to return to their initial elevated position. The seal unit carrier 28 is then retracted from the formed part and the pivot arms 32 of the part locator are then retracted open position by their pneumatic cylinder 34 leaving the hydroformed part free to be removed from the hydroforming apparatus such as by the aforementioned robot. And the apparatus is then ready for the commencement of another complete cycle.

It will also be understood that the finished part may be removed by another robot to thereby speed up the loading and unloading of the part and reduce the total hydroforming processing time. And it will also be appreciated that the part locator assembly as arranged and described above is quite compact in that it has both a relatively short width and length for the various operations that it performs.

Moreover, it will be appreciated that a substantial reduction in cycle time is accomplished by not requiring a robot or other type of loader to hold the tubular part until the seal unit carrier 28 advances and then having to leave from an interference position between the dies that prevents their closure until after the seal unit engagement is effected. The pivot arms 32 instead holding the tubular part on the locator member 31 for seal unit engagement without requiring additional cycle time by permitting removal of the robot from between the dies immediately following its dropping of the tubular part on the locator member.

Figure 10:
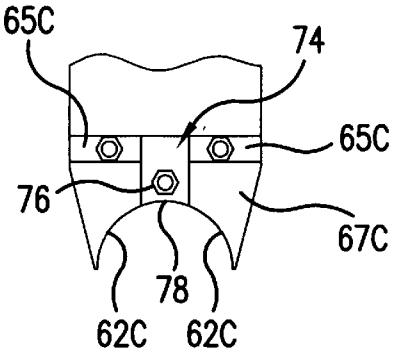
FIG. 10 is a partial view of the opposite side of the backup member in FIG. 9.
Figure 9:
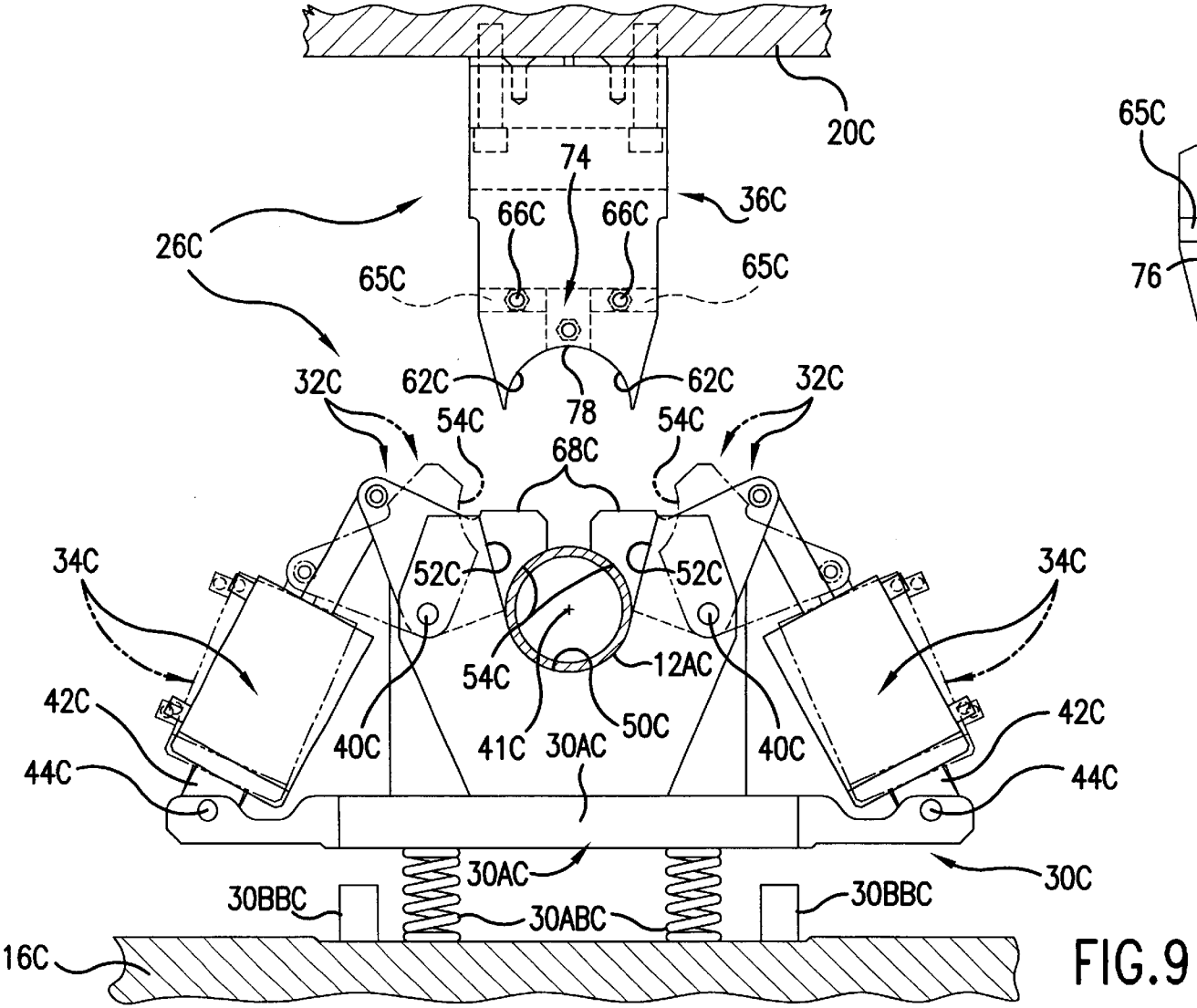
FIG. 9 is a view like FIG. 2 but of another embodiment of the part locator according to the present invention.

Further reduction in cycle time is provided by the embodiment of the tubular part locator shown in FIGS. 9 and 10 wherein the same reference numbers including suffix letters used in FIGS. 1–8 are used but with the suffix letter "C" added and wherein certain distinguishing features are identified by new reference numbers. As shown in FIGS. 9 and 10, the tubular part locator 26C has shortened pivot arms 32C wherein their concave surface 54C is significantly less than a quarter-circular cylindrical surface. And the axes of the pivot pins 40C now lie in a horizontal plane located substantially below the centerline 41C of the concave surface 50 of the locator member 31C. Thereby reducing the pivot arm protrusion over the locator member and minimizing the loading path for the part onto the locator member and thus the cycle time for the part loading operation and like wise the unloading path and unloading time.

These modifications however leave a gap between the concave surfaces 54C of the pivot arms 32C when the latter are in their part clamping position as shown in FIG. 9. And this gap is filled when the backup member 36C is moved to its backup position by an insert 74 that is mounted in the backside recess 67C of the backup member 36C between the stop members 65C and is fastened in place to the backup member by a fastener 76.

The insert 74 has a concave cylindrical surface 78 that provides an intermediate uninterrupted continuation of the concave surface 62C on the backup member 36C. And the insert moves to a filling position between the pivot arms 32C when the backup member 36C is moved to its backup position where its concave surface 78 then cooperates with the concave surface 62C of the backup member and the shortened concave surfaces 54C of the pivot arms in clamping the part on the locator member. The tubular part locator 26C in FIGS. 9 and 10 otherwise operates like the tubular part locator 26 as previously described.

Figure 11:
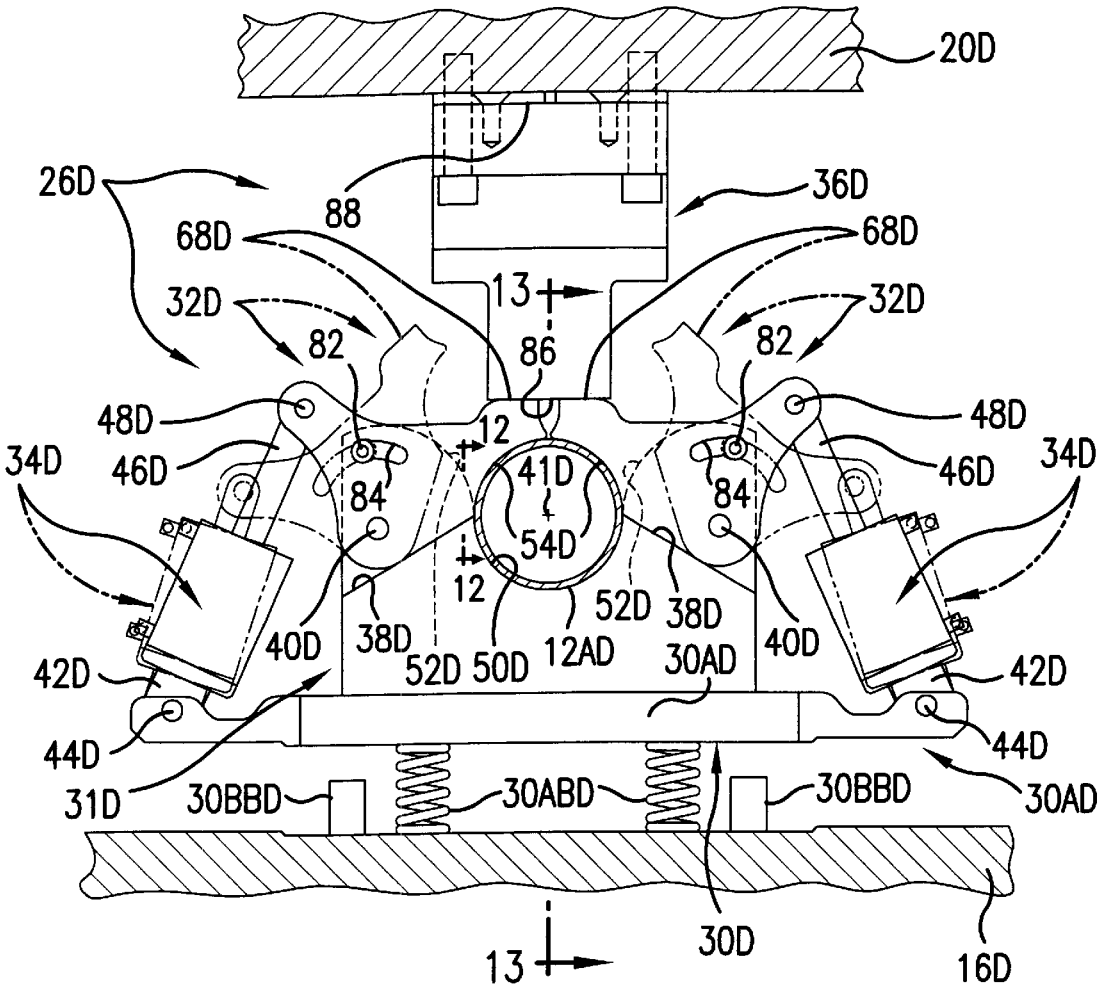
FIG. 11 is a view like FIG. 6 but of another embodiment of the part locator according to the present invention and looking from the opposite or rear side.
Figure 12:
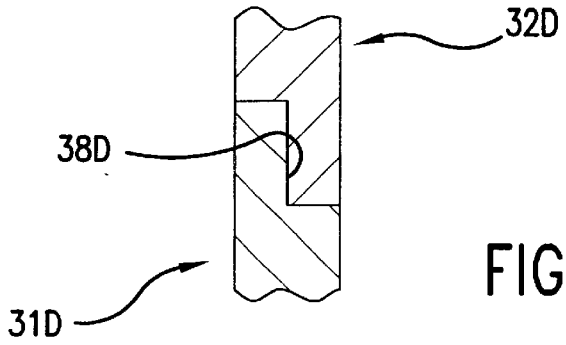
FIG. 12 is a view taken along the line 12—12 in FIG. 11 when looking in the direction of the arrows.
Figure 13:
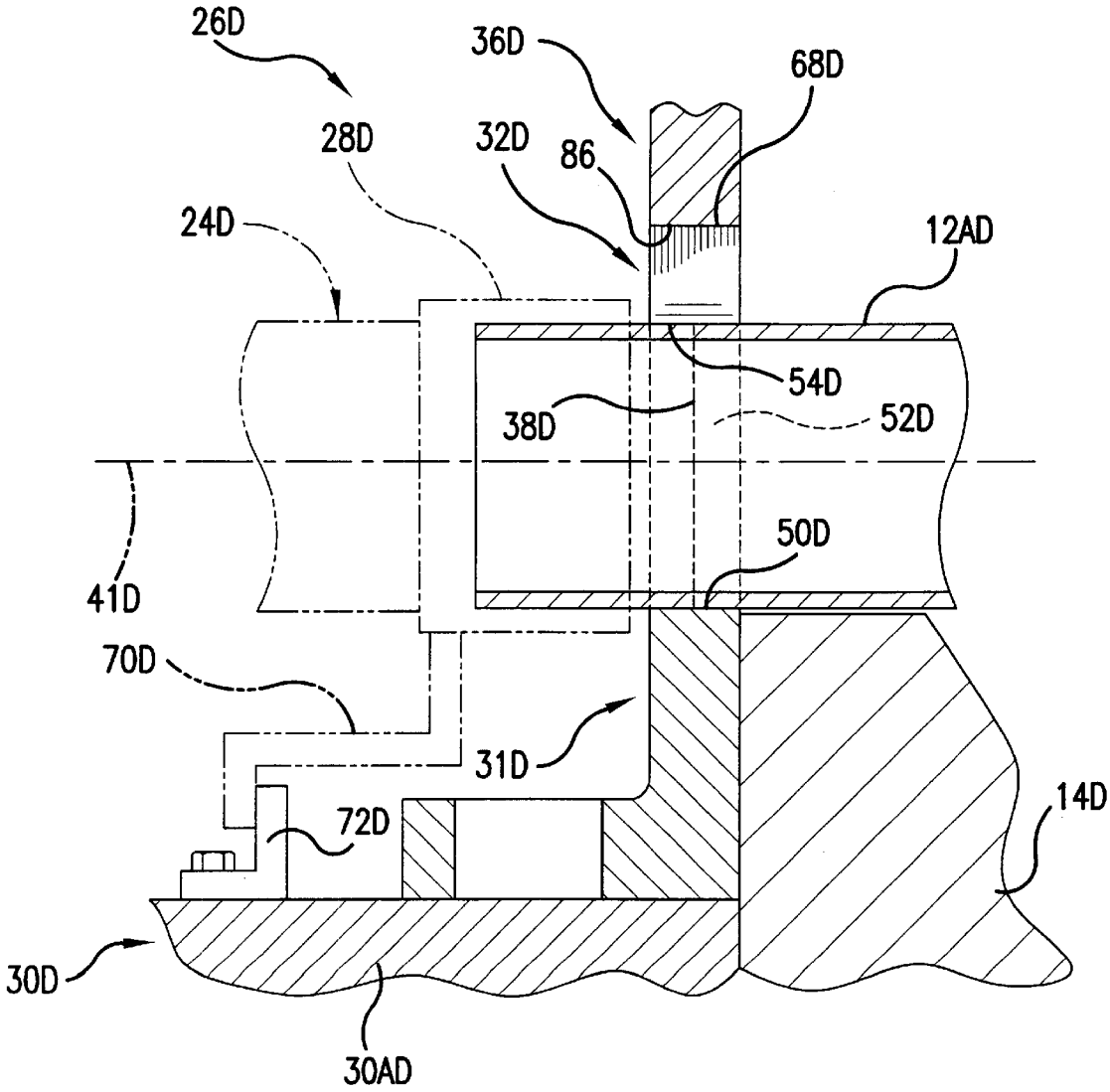
FIG. 13 is a view taken along the line 13—13 in FIG. 11 when looking in the direction of the arrows.

A simpler more compact tubular part locator according to the present invention is shown with the embodiment in FIGS. 11–13 wherein the same reference numbers including suffix letters used in FIGS. 1–8 are used but with the suffix letter "D" added and wherein certain distinguishing features are identified by new reference numbers. Referring to FIG. 11, the locations of the axes of the pivot arm pivot pins 40D are located below the centerline 41D of the concave surface 50D of the locator member 31D like in the FIGS. 9 and 10 embodiment. But the clamping portion of the pivot arms 32D are now as wide as the locator member 31D (see FIG. 12). And the guide edge surfaces on the locator member 31D instead of being straight flat surfaces as in the two previous embodiments are now formed as converging concave or rounded edge surfaces 52D that join with the semi-circular concave surface 50D on the locator member to guide a part onto the latter surface while avoiding interference between the clamping portion of the pivot arms 32D and the locator member 31D.

The pivot arms 32D again have a quarter-circular cylindrical surface 54D but in this embodiment the pivot arms are retained in the respective recesses 38D in the backside of the locator member 31D by a fastener 82 that extends freely through an arcuate slot 84 in the respective pivot arm and is fastened to the locator member. Moreover, that portion of the pivot arms 32D having the clamping surface 54D has the same width as the clamping surface 50D of the locator member 31D of the locator so that the locator member and pivot arm clamping surfaces 50D and 54D form a continuous or uninterrupted clamping surface of uniform width about the end portion 12AC of the tubular part when the pivot arms are moved to their clamping position. See FIGS. 12 and 13. As a result, there is no need for stop members or a clamping surface on the backup member 31D as in the previous embodiments. And instead there is simply provided a flat edge surface 86 on the backup member 36D that is located with lowering of the upper die 20D so as to be engaged by the edge surface 68D of the pivot arms 32D and thereby hold the latter against the hydroforming pressure in the end portion 12AD of the tubular part to thereby relieve the pneumatic cylinders 34D of this task.

With the adjustable stop members eliminated, the spacing or clearance previously described between the pivot arms and the stop members on the backup member in the previous embodiments is in this embodiment between the edge surface 68D of the pivot arms 32D and the edge surface 86 of the backup member 36D. This clearance occurring when the pivot arms 32D are in their clamping position and the backup member 36D is in its backup position as shown. And this clearance is simply adjusted as desired at assembly by utilizing a spacer member 88 of appropriate thickness that is sandwiched between the backup member 36D and the press plate 20D where they are fastened together.

Having described the above exemplary embodiments in a manner to clearly and precisely disclose and teach the present invention, various other forms thereof and modifications thereto will quite likely occur as a result of this disclosure and teaching and particularly from the practicing of this invention by those skilled in this art. Therefore, it will be understood that the present invention is intended to be limited only by the scope of the appended claims.

What is claimed is:

1. Hydroforming apparatus including a seal unit, a part locator for locating and holding a tubular part in alignment with said seal unit, said part locator comprising a locator member having a concave surface and adjoining guide surfaces wherein said concave surface has a shape conforming to the outer surface of the part and a centerline line coincident with the centerline of said seal unit and wherein said guide surfaces are adapted to guide an end portion of the part onto said concave surface and thereby into alignment with the seal unit, a pair of pivot arms each having a concave surface conforming to the outer surface of the part and adapted on pivotal movement of said pivot arms in opposite directions to clamping positions to clamp the end portion of the part on the concave surface of said locator member, and a backup member adapted on movement of said backup member to a backup position to hold said pivot arms in their clamping position during hydroforming of the part.

2. Hydroforming apparatus as defined in claim 1 wherein the tubular part is round, said concave surface of said locator member is a semicircular cylindrical surface, and said concave surface of said pivot arms is a quarter-circular cylindrical surface.

3. Hydroforming apparatus as defined in claim 1 wherein the tubular part is round, said concave surface of said locator member is a semi-circular cylindrical surface, said concave surface of said pivot arms is substantially less than a quarter-circular cylindrical surface whereby a gap exists between the concave surfaces of said pivot arms when said pivot arms are in their clamping position, and said backup member has a semi-circular cylindrical concave surface conforming to the outer surface of the part and is formed in part by an insert wherein said insert is adapted to enter and fill said gap on movement of said backup member to said backup position and wherein said semi-cylindrical surface of said backup member is adapted to also clamp the end portion of the part on the concave surface of said locator member in cooperation with said concave surface of said pivot arms when said backup member is in said backup position.

4. Hydroforming apparatus as defined in claim 1 wherein said pivot arms have a pivot axis laying in a plane passing through the centerline of said concave surface of said locator member.

5. Hydroforming apparatus as defined in claim 1 wherein said pivot arms have a pivot axis laying in a plane located substantially below the centerline of said concave surface of said locator member.

6. Hydroforming apparatus as defined in claim 1 wherein there is a lower die, an upper die adapted to cooperate with said lower die to form a die cavity for the hydroforming of the tubular part when said upper die is lowered to press against said lower die, said die cavity including a bore for receiving the end portion of the tubular part, said backup member is rigidly fixed with respect to said upper die, an elevator supporting said locator member and said seal unit with respect to said lower die, a pusher member rigidly fixed with respect to said upper die, and said elevator adapted to be operated by said pusher member to position said locator member and said seal unit with the end portion of the tubular part in alignment with said die cavity bore when said upper die is pressed against said lower die and said backup member is concurrently moved to said backup position following movement of said pivot arms to their clamping position.

7. Hydroforming apparatus as defined in claim 1 wherein said pivot arms are received in a recess in one side of said locator member so as to be flush with said one side, and said backup member has adjustable stop members abuttable with said pivot arms for holding said pivot arms in their clamping position and said backup member is moved to said backup position.

8. Hydroforming apparatus as defined in claim 2 wherein said guide surfaces are flat surfaces that converge in the direction of said concave surface of said locator member.

9. Hydroforming apparatus as defined in claim 3 wherein said guide surfaces are convex surfaces that converge in the direction of said concave surface of said locator member.

10. Hydroforming apparatus as defined in claim 6 wherein the tubular part is round, said concave surface of said locator member is a semi-circular cylindrical surface, said concave surface of said pivot arms is a quarter-circular cylindrical surface, said guide surfaces are flat surfaces that converge in the direction of said semi-circular cylindrical surface of said locator member, and said pivot arms have a pivot axis laying in a plane passing through the centerline of said semi-circular cylindrical surface of said locator member.

11. Hydroforming apparatus as defined in claim 6 wherein the tubular part is round, said concave surface of said locator member is a semi-circular cylindrical surface, said concave surface of said pivot arms is substantially less than a quarter-circular cylindrical surface, said guide surfaces are convex surfaces that converge in the direction of said semi-circular cylindrical surface of said locator member, and said pivot arms have a pivot axis laying in a plane located substantially below the centerline of said semi-circular cylindrical surface of said locator member.

12. Hydroforming apparatus including a seal unit, a tubular part locator for locating and holding a tubular part in alignment with said seal unit, said tubular part locator comprising a locator member having a concave surface and adjoining guide surfaces wherein said concave surface has a shape conforming to the outer surface of the part and a centerline line coincident with the centerline of said seal unit and wherein said guide surfaces are adapted to guide an end portion of the tubular part onto said concave surface of said locator member and thereby into alignment with the seal unit, a pair of pivot arms each having a concave surface conforming to the outer surface of the part and adapted on pivotal movement of said pivot arms in opposite directions to clamping positions to clamp the end portion of the part on the concave surface of said locator member, a backup member adapted when moved to a backup position to hold said pivot arms in their clamping position during hydroforming of the part, and said backup member also having a concave surface conforming to the outer surface of the part and adapted on movement of said backup member to a backup position to clamp the end portion of the part on the concave surface of said locator member in cooperation with the concave surface of said pivot arms.

13. Hydroforming apparatus as defined in claim 12 wherein the tubular part is round, said guide surfaces are flat surfaces and converge in the direction of said concave surface of said locator member, said concave surface of said locator member and that of said backup member is a semi-circular cylindrical surface, and said concave surface of said pivot arms is a quarter-circular cylindrical surface.

14. Hydroforming apparatus as defined in claim 12 wherein the tubular part is round, said guide surfaces are convex surfaces and converge in the direction of said concave surface of said locator member, said concave surface of said locator member and that of said backup member is a semi-circular cylindrical surface, said concave surface of said pivot arms is substantially less than a quarter-circular cylindrical surface, and said backup member has an insert that enters between said pivot arms and cooperates with said concave surface of said pivot arms to form a semi-circular cylindrical surface when said pivot arms are in their clamping position and said backup member is in said backup position.

15. Hydroforming apparatus as defined in claim 12 wherein there is a lower die, an upper die adapted to cooperate with said lower die to form a die cavity for the hydroforming of the part when said upper die is lowered to press against said lower die, said die cavity including a bore for receiving the end portion of the part, said backup member is rigidly fixed with respect to said upper die, an elevator supporting said locator member and said seal unit with respect to said lower die, a pusher member rigidly fixed with respect to said upper die, and said elevator adapted to be operated by said pusher member to position said locator member and said seal unit with the end portion of the part in alignment with said die cavity bore when said upper die is pressed against said lower die and said backup member is concurrently moved to said backup position.

* * * * *